US010812884B2

(12) United States Patent
Combest et al.

(10) Patent No.: US 10,812,884 B2
(45) **Date of Patent: *Oct. 20, 2020**

(54) HANGING SPEAKER SYSTEM

(71) Applicant: MS ELECTRONICS LLC, Overland Park, KS (US)

(72) Inventors: Christopher E. Combest, Leawood, KS (US); Lindsey K. Humphrey, Kansas City, MO (US)

(73) Assignee: MS Electronics, LLC, Overland Park, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/244,268

(22) Filed: Jan. 10, 2019

(65) Prior Publication Data

US 2020/0228886 A1 Jul. 16, 2020

(51) Int. Cl.
*H04R 1/02* (2006.01)
*H04R 3/14* (2006.01)
*H04R 1/24* (2006.01)

(52) U.S. Cl.
CPC ..... *H04R 1/026* (2013.01); *H04R 1/24* (2013.01); *H04R 3/14* (2013.01)

(58) Field of Classification Search
CPC ..... H04R 1/28; H04R 1/2803; H04R 1/2826; H04R 1/2846; H04R 1/2857; H04R 2201/021
See application file for complete search history.

(56) References Cited

U.S. PATENT DOCUMENTS 5,995,634 A * 11/1999 Zwolski ..... H04R 1/028 181/155
6,144,751 A * 11/2000 Velandia ..... H04R 1/2826 181/153
2016/0227315 A1* 8/2016 Kim ..... H04R 1/288
2017/0006376 A1* 1/2017 Tan ..... H04R 1/345
2017/0094403 A1* 3/2017 Tipparaju ..... H04R 1/288

* cited by examiner

*Primary Examiner* — Sunita Joshi
(74) *Attorney, Agent, or Firm* — Hovey Williams LLP

(57) ABSTRACT

A speaker system broadly comprises a plurality of speaker assemblies each including a speaker housing, an input circuit, a low range speaker, and a higher-range speaker. The input circuit receives audio signals from a sound system or other controller and actively or passively sends the audio signals to the speakers. The low-range speaker is positioned in the upper section and the higher-range speaker is positioned in the lower section. Each speaker assembly is configured to be suspended from an elevated structure and spaced from the other speaker assemblies within a listening area with each speaker assembly generating low frequency soundwaves and higher-frequency soundwaves. This reduces or eliminates out-of-phase crossover frequency wave cancellation effects within the listening area. The speaker housings are compact while allowing the low-range speaker and higher-range speaker to effectively produce and project desired soundwaves from the suspended speaker housing into the listening area.

20 Claims, 5 Drawing Sheets

HANGING SPEAKER SYSTEM

BACKGROUND

Speakers are often used in shopping areas, atriums, foyers, pavilions, and other at least partially enclosed areas for reproducing music, talk radio, and other audio. Conventional speaker systems often include a low-range speaker such as a subwoofer and a number of higher-range speakers spaced from the low-range speaker. The frequency ranges of the low-range speaker and the higher-range speakers often overlap, with crossover frequency soundwaves being generated by both the low range speaker and the higher-range speakers. When the speakers are spaced apart, the crossover frequency soundwaves are often out of phase with each other in portions of the listening area, thus resulting in unwanted wave cancellation or muting effects.

Such speakers are often positioned on floors, placed on countertops, tables or other furniture, or mounted to walls. This can displace other fixtures or furniture, distract from the intended ambience of the listening area, and/or result in suboptimal acoustics.

SUMMARY

Embodiments of the invention solve the above-mentioned problems and provide a distinct advance in the art of speaker assemblies and speaker systems. More particularly, the invention provides a hanging speaker system broadly comprising a number of speaker assemblies configured to be hung from a ceiling or other elevated structure to form a listening area. Each speaker assembly generates low frequency soundwaves and higher frequency soundwaves while reducing or eliminating out-of-phase crossover frequency wave cancellation effects when spaced from the other speaker assemblies within the listening area.

Each speaker assembly of the speaker system broadly comprises a speaker housing, a hanging component, an input circuit, a low range speaker, and a higher-range speaker. The speaker housing broadly comprises an upper section and a lower section. The speaker housing may be substantially cylindrical and narrow for allowing the speaker assembly to be less conspicuous and positioned in narrow spaces.

The upper section encloses the low range speaker and broadly comprises an outer wall and a divider. The outer wall defines an upper chamber and a lower chamber. A lower end of the outer wall may be flared radially outward slightly, the purpose of which will be described below. The upper section may be formed of PVC or other plastic, metal, or any other suitable material and may be waterproof and/or corrosion resistant.

The upper section also includes a connector for securing the speaker housing to the hanging component. The connector is positioned near a middle of the top of the upper section so that the speaker assembly is balanced and oriented vertically upright when hanging from the ceiling.

The upper chamber retains the low-range speaker therein and is acoustically shaped for projecting low frequency soundwaves generated by the low-range speaker down to the lower chamber. The upper chamber may also have any suitable size for optimizing the projection of low frequency soundwaves therefrom.

The lower chamber encircles at least a portion of the lower section and allows low frequency soundwaves generated by the low range speaker to pass out of a lower port exit of the speaker housing via a lower port channel. The lower chamber is acoustically shaped and may have any suitable size for optimizing the projection of low frequency soundwaves generated by the low range speaker downwards through the lower port channel and outwards through the lower port exit.

The divider extends horizontally in the upper section and partitions the upper section into the upper chamber and the lower chamber. The divider also supports the low-range speaker such that the low-range speaker is spaced from a top of the upper section.

The lower section encloses the higher-range speaker and broadly comprises an outer wall, a baffle, and a plurality of vanes. The outer wall includes an upper portion and a lower portion and forms an inner chamber. The lower section and the outer wall cooperatively form the lower port exit.

The upper portion extends upwards into the lower chamber of the upper section and thus has a smaller outer diameter than an inner diameter of the outer wall. The upper portion also has a smaller outer diameter than an outer diameter of the lower portion. The upper portion extends upwards a selected vertical length into the lower chamber so as to effect a desired length of the lower port channel. This optimizes low frequency output. If a cross section area of the lower port channel and/or the lower port exit is increased, the length of the lower port channel should be increased. Likewise, if the cross section area of the lower port channel and/or the lower port exit is decreased, the length of the lower port channel should be decreased. Meanwhile, decreasing the cross section area of the lower port exit increases air velocity therethrough, which may cause port noise. Thus, the lower end of the outer wall of the upper section near the lower port exit may be flared radially outward slightly so as to increase the cross section area of the lower port exit and thereby reduce port noise. A longer flare may provide more port noise mitigation.

The lower portion has a larger diameter than the upper portion and has an outer diameter substantially equal to the outer diameter of the outer wall. As such, the lower portion and the outer wall of the upper section appear essentially as vertical extensions of each other separated by the lower port exit.

The inner chamber encloses the higher range speaker therein and is acoustically shaped for projecting higher-frequency soundwaves. The inner chamber may have any suitable size for optimizing the projection of higher-frequency soundwaves.

The baffle encloses the inner chamber of the lower section and extends radially beyond the lower portion. The baffle concentrates higher frequency soundwaves below the speaker assembly. The baffle may be sized to optimize directivity and amplitude of the higher frequency soundwaves. The baffle may be a cover, a plate, or any other suitable enclosing structure.

The vanes extend radially outward from the upper portion of the outer wall of the lower section to the outer wall of the upper section so as to connect the lower section to the upper section. The vanes also divide the lower port channel into a plurality of radial spaces. The radial spaces are vertically extending pathways through which low frequency soundwaves from the low-range speaker may pass from the lower chamber to the lower port exit.

The hanging component suspends the speaker assembly from a ceiling or other elevated structure and is secured to an anchor or other mounting feature of the ceiling near its upper end and is secured to the connector at its lower end. The hanging component may support or house electrical or electronic wiring connected between the input circuit and a sound system and/or a power source. The hanging component may be a cable, a chain, a wire, a rope, a rigid member, or any other suitable structure.

The input circuit receives audio signals from the sound system and actively or passively sends the audio signals to the speakers. The input circuit may include an antenna, data bus, data port, or any other suitable communication component, an amplifier, a mixer, or any other suitable sound manipulation component. The input circuit may be positioned in the upper section, the lower section, or any other location for improving signal reception.

The low range speaker generates low frequency soundwaves and is positioned in or mounted to the divider and aimed upwards or downwards for projecting the low frequency soundwaves through the lower port channel (via the radial spaces) and out the lower port exit. The low range speaker may be a woofer, subwoofer, bass speaker, or other low-range speaker.

The higher-range speaker generates higher frequency soundwaves and is positioned in or mounted to the baffle. The higher-range speaker is aimed downwards for projecting higher frequencies. The higher-range speaker may be a full range speaker, a woofer with a tweeter, a woofer with a midrange and tweeter, or any other similar speaker or combination of speakers.

The speaker assembly provides several advantages. For example, the speaker assembly is spaced apart from other speaker assemblies throughout the listening area such that low frequency soundwaves and higher frequency soundwaves can be received from at least one of the speaker assemblies for most and/or key regions of the listening area. In this way, soundwaves of a particular crossover frequency from a low-range speaker located at a given position and soundwaves of the same crossover frequency from a higher-range speaker located at the same position will not form acoustically muted regions.

The speaker assembly is suspended from the ceiling or another elevated structure via the hanging element for providing audio to the listening area. This also allows the speaker assembly to be concealed or positioned so as to not draw attention thereto. The cylindrical shape of the speaker housing further diverts attention from the speaker assembly.

The upper portion of the lower section may extend upwards a selected vertical length so as to effect a desired length of the lower port channel. This may allow acoustics of the low frequency soundwaves to have a desired effect and may reduce port noise.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
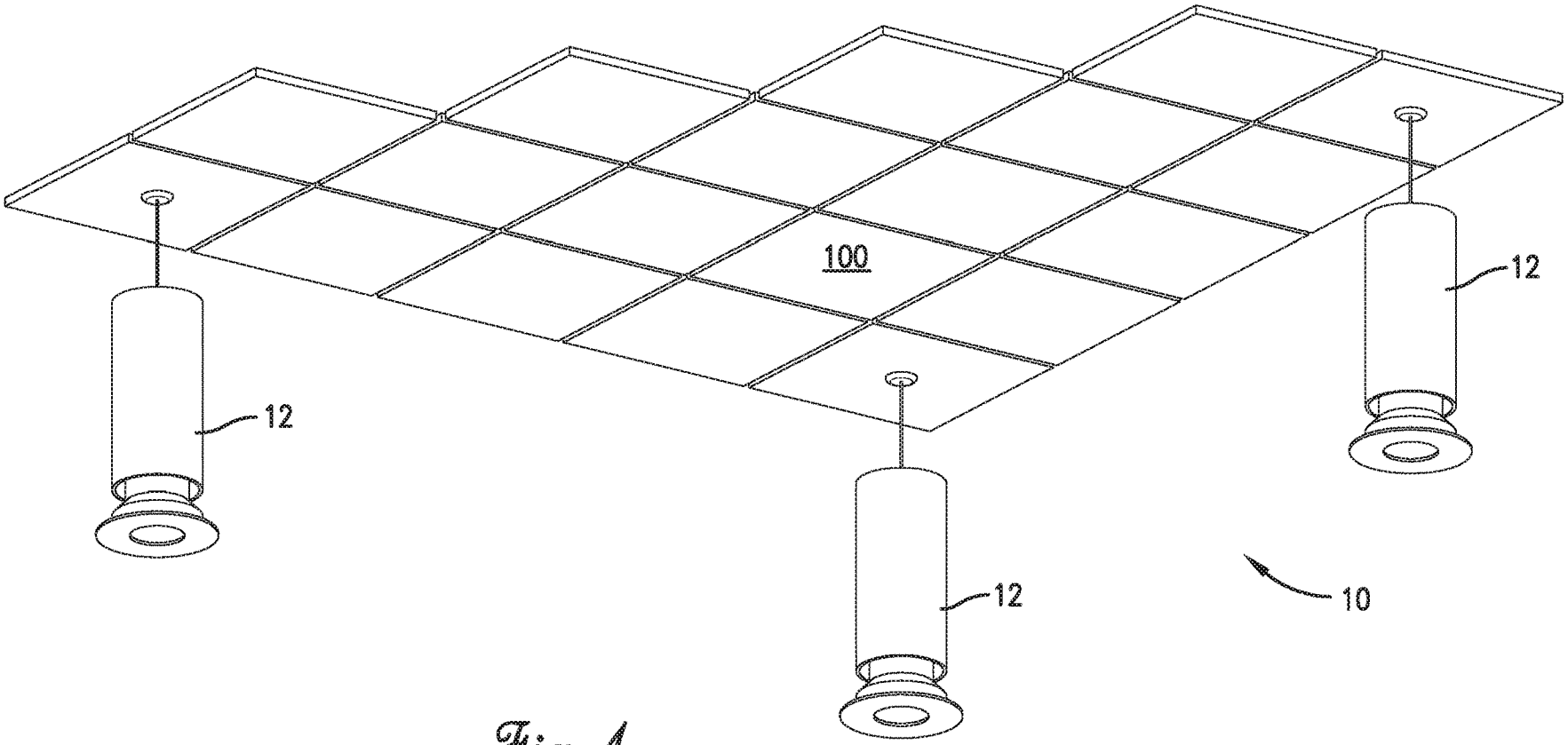
FIG. 1 is an environmental view of a speaker system constructed in accordance with an embodiment of the invention and including a number of speaker assemblies.
Figure 2:
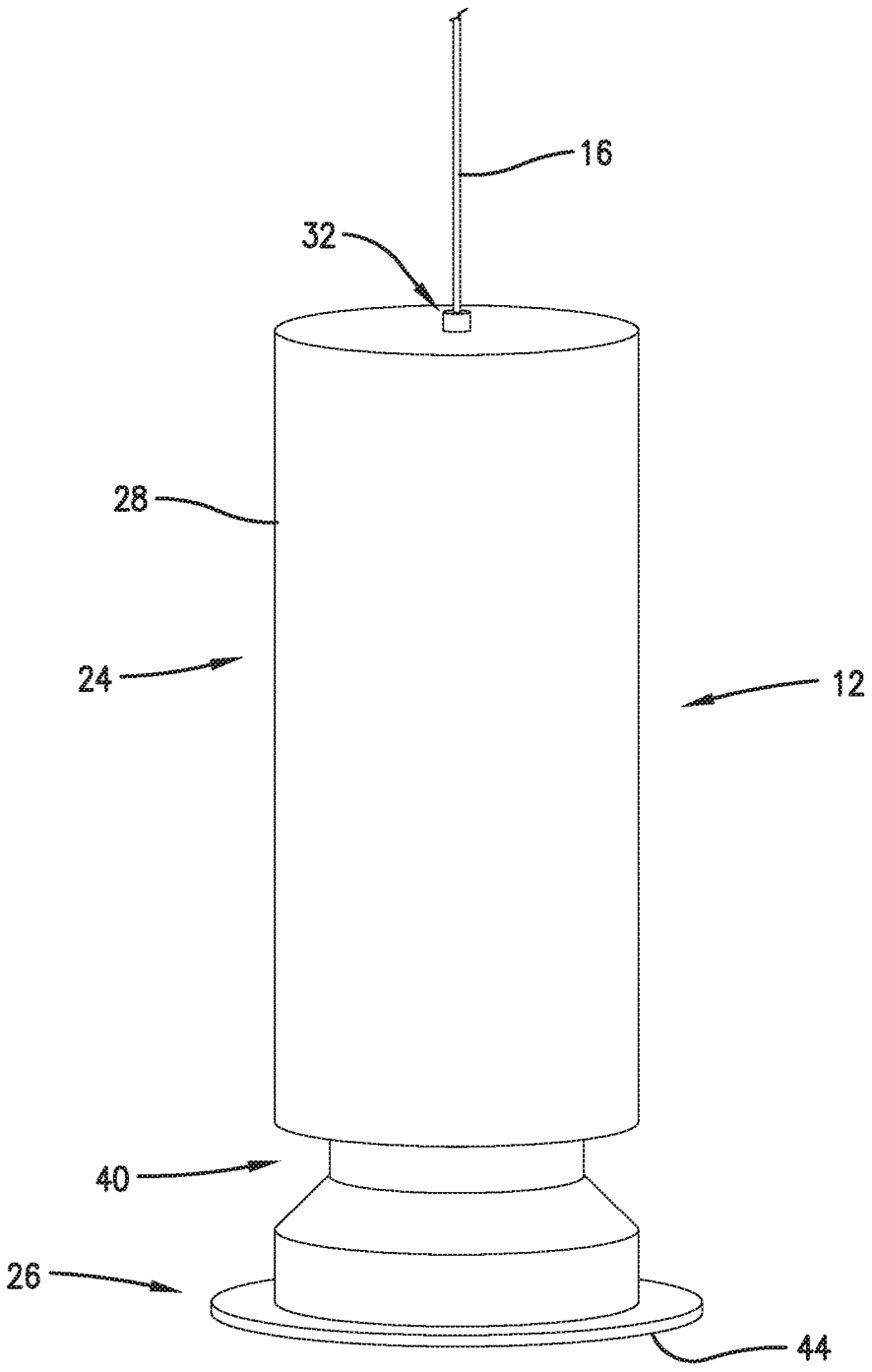
FIG. 2 is a perspective view of one speaker assembly of the speaker system shown in FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, a hanging speaker system 10 constructed in accordance with an embodiment of the invention is illustrated. The hanging speaker system 10 broadly comprises a number of speaker assemblies 12 configured to be spaced apart from each other and hung from a ceiling 100 or other elevated structure to form a listening area. The speaker assemblies 12 may be communicatively connected to a sound system 102 such as an audio receiver, radio tuner, amplifier, mixer, computer, mobile computing device, portable music player, or any other suitable audio-capable electronic device via wires or wireless communication technology such as an internet connection, Bluetooth connection, radio frequency connection, cellular network, near field communication connection, or any other suitable wireless connection.

Embodiments of the speaker assemblies 12 will now be described in more detail. The speaker assemblies 12 each broadly comprise a speaker housing 14, a hanging component 16, an input circuit 18, a low range speaker 20, and a higher-range speaker 22.

Figure 3:
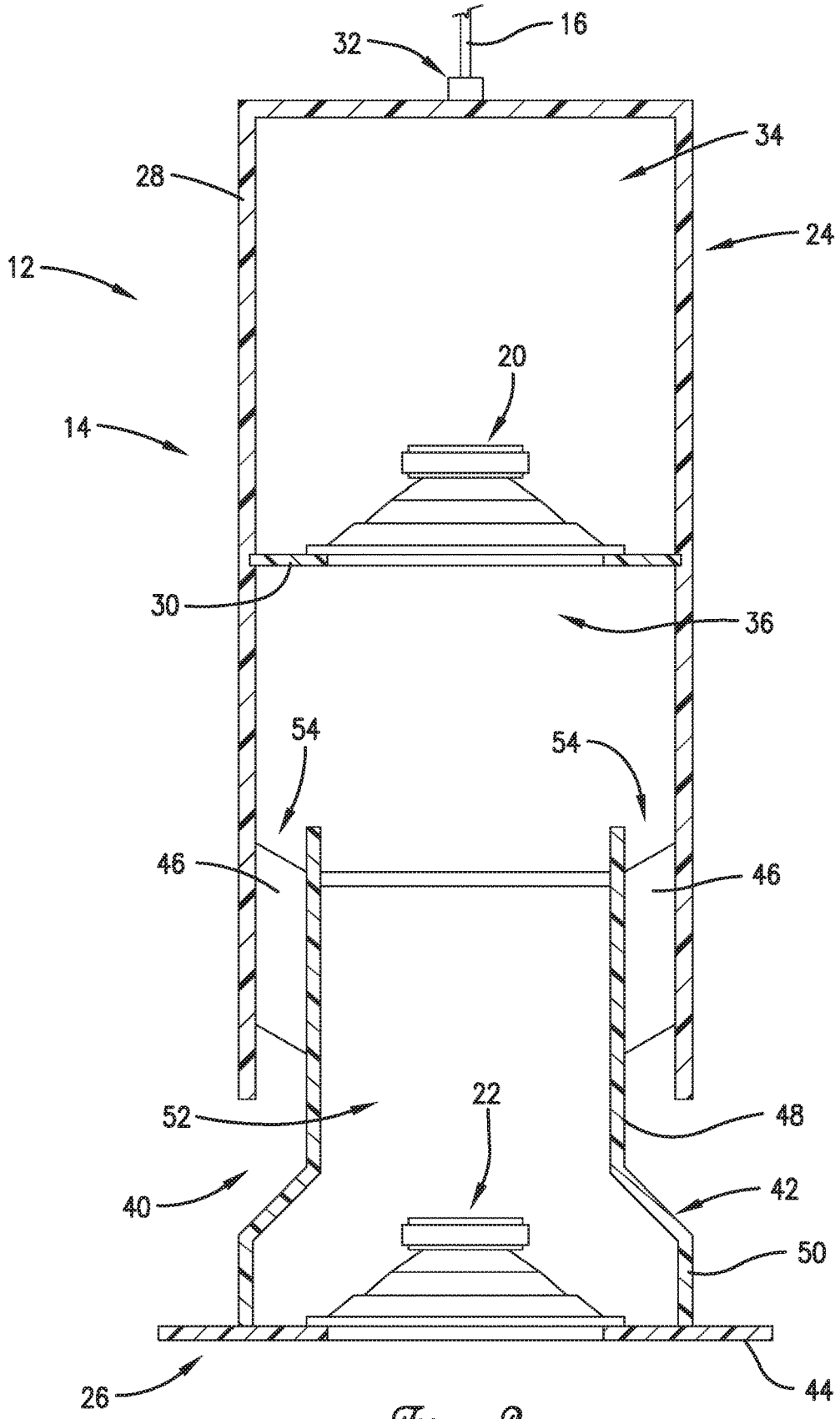
FIG. 3 is a cutaway elevation view of the speaker assembly of FIG. 2.
Figure 4:
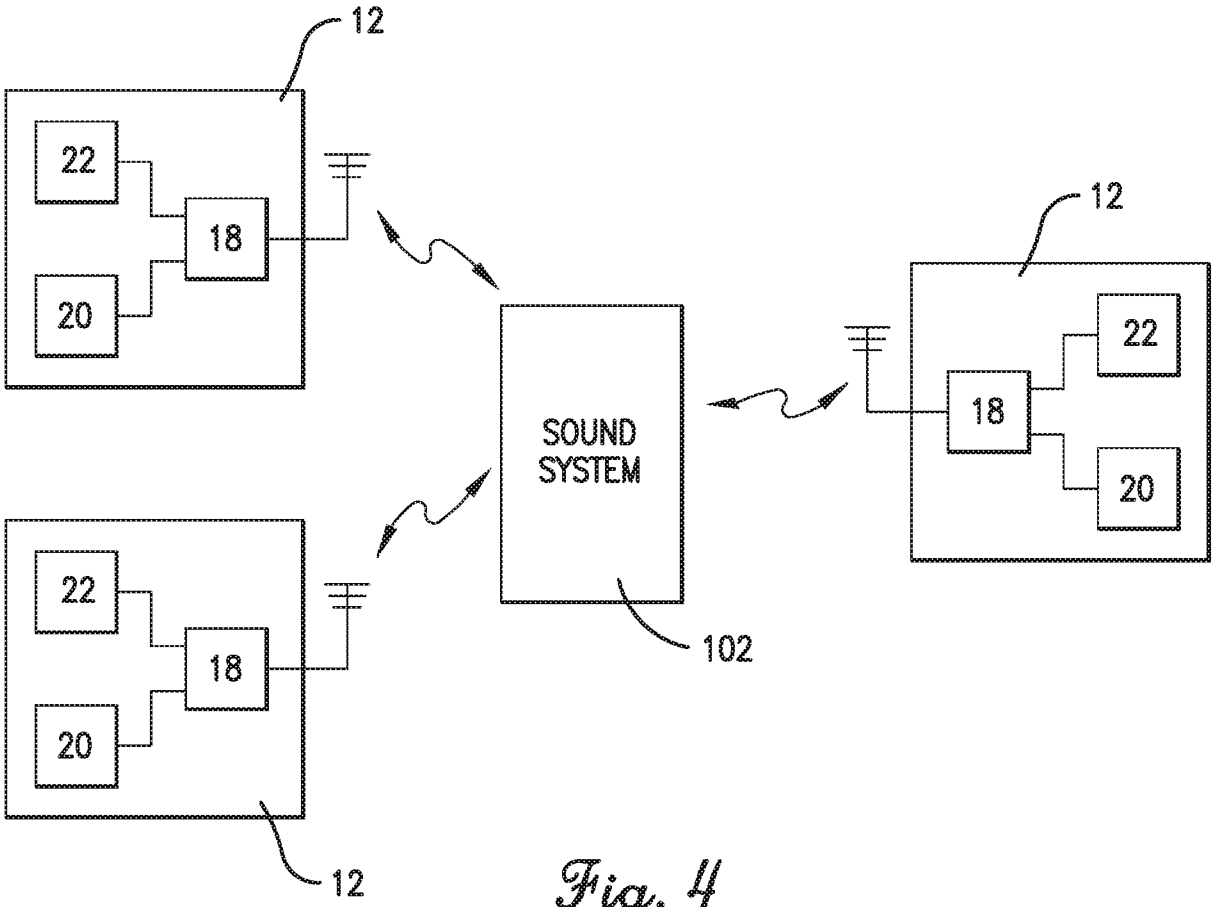
FIG. 4 is a schematic diagram of the speaker system of FIG. 1 in wireless communication with a sound system in accordance with another embodiment of the invention.
Figure 5:
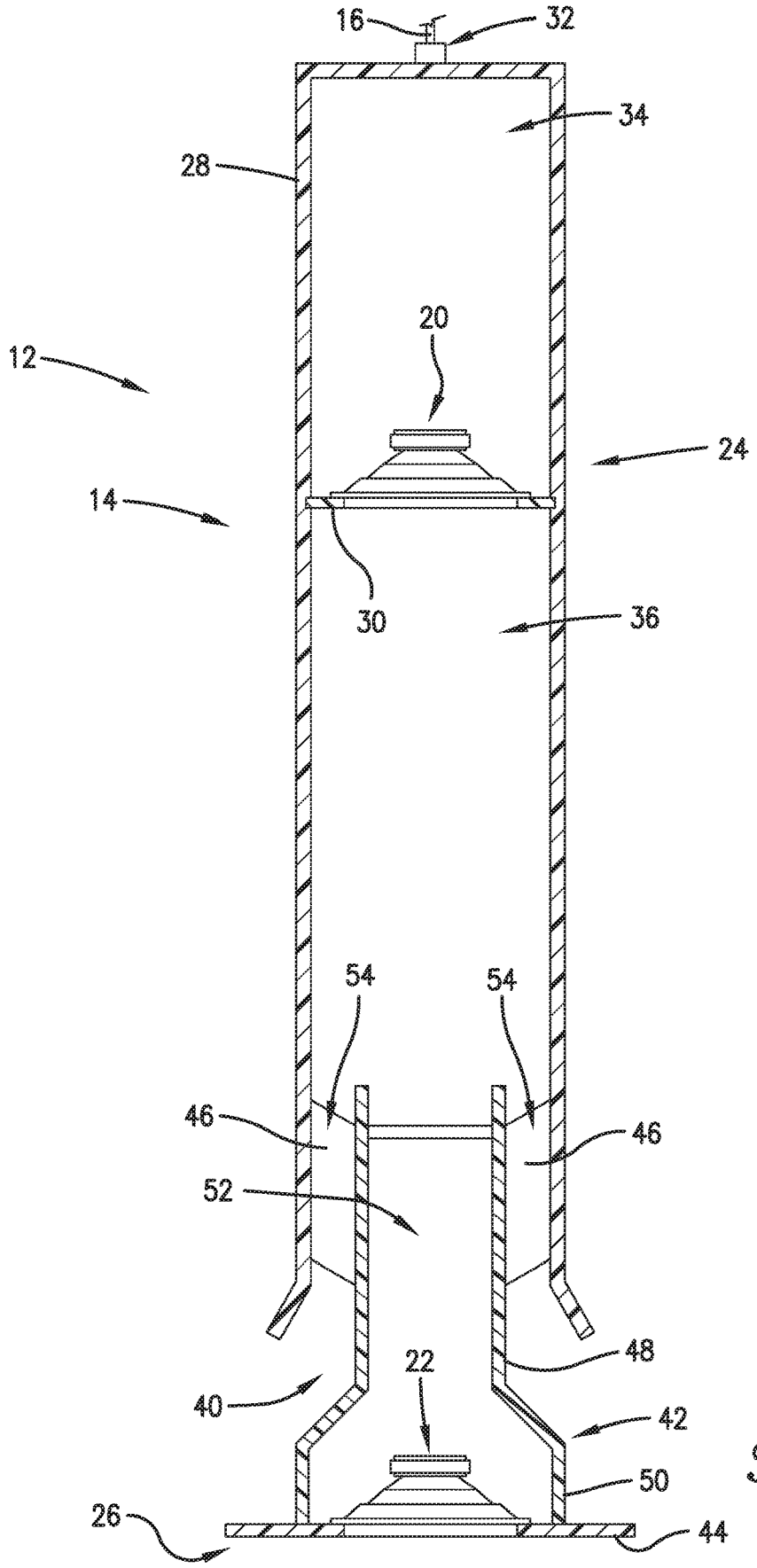
FIG. 5 is a cutaway elevation view of a speaker assembly constructed in accordance with another embodiment of the invention.

The speaker housing 14 protects the input circuit 18 and speakers 20, 22 from the environment and broadly comprises an upper section 24 and a lower section 26. The speaker housing 14 may have an outer diameter of between five inches and twelve inches (not including the baffle described below) and a height of between approximately twenty inches and approximately forty inches. In one embodiment, the speaker housing 14 has an outer diameter of approximately ten inches and a height of approximately twenty-seven inches (FIG. 3). In another embodiment, the speaker housing 26 has an outer diameter of approximately six inches and a height of approximately thirty-seven inches (FIG. 5). The small diameter of the speaker housing 14 allows the speaker assembly 12 to be less conspicuous and may allow the speaker assembly 12 to be positioned in narrow spaces.

The upper section 24 encloses the low range speaker 20 and broadly comprises an outer wall 28, a divider 30, and a connector 32. The outer wall 28 defines an upper chamber 34 and a lower chamber 36. The outer wall 28 may have a thickness of between approximately one eighth of an inch and approximately three fourths of an inch. In one embodiment, a lower end of the outer wall 28 may be flared radially outward slightly (FIG. 5), the purpose of which will be described below. The outer wall 28 may have an outer diameter of between approximately five inches and approximately twelve inches. In one embodiment, the outer wall 28 has an outer diameter of approximately ten inches (FIG. 3). In another embodiment, the outer wall 28 has an outer diameter of approximately six inches (FIG. 5). The upper section 24 may be formed of PVC or other plastic, metal, or any other suitable material and may be waterproof and/or corrosion resistant.

The upper chamber 34 retains the low-range speaker 20 therein and may be acoustically shaped for projecting low frequency soundwaves generated by the low-range speaker 20 downwards and/or outwards. To that end, the outer wall 28 may be cylindrical, orthogonal, spherical, or any other suitable shape. The upper chamber 34 may also have any suitable size for optimizing the projection of desired low frequency soundwaves therefrom.

The lower chamber 36 encircles the lower section 26 and allows low frequency soundwaves generated by the low range speaker 20 to pass out of the speaker housing 14 via a lower port channel 38 and a lower port exit 40. The lower chamber 36 may be acoustically shaped for projecting low frequency soundwaves generated by the low range speaker 20 downwards through the lower port channel 38 and outwards through the lower port exit 40. To that end, the outer wall 28 may be cylindrical, orthogonal, spherical, or any other suitable shape. The lower chamber 36 may also have any suitable size for optimizing the projection of desired low frequency soundwaves therefrom.

The divider 30 extends horizontally in the upper section 24 and partitions the upper section 24 into the upper chamber 34 and the lower chamber 36. The divider 30 also supports the low-range speaker 20 such that the low-range speaker 20 is spaced from a top of the upper section 24. The divider 30 may be spaced from the top of the upper section 24 between approximately six inches and approximately fifteen inches and spaced from a top of the lower section 26 between approximately three inches and approximately fifteen inches. In one embodiment, the divider 30 is spaced approximately six inches from the top of the upper section 24 and spaced approximately seven inches from the top of the lower section 26. That is, the divider 30 may be positioned any suitable height below the top of the upper section 24 and above the top of the lower section 26 for optimizing the projection of desired low frequency soundwaves from the upper chamber 34 and lower chamber 36.

The connector 32 secures the hanging component 16 to the speaker housing 14 and may be positioned near a middle of the top of the upper section 24 so that the speaker assembly 12 is balanced and oriented vertically upright when hanging from the ceiling 100. The connector 32 may be integrally formed into the outer wall 28 of the upper section 24 such as a molded connection boss. The connector 32 may be an anchor, a hook, a fastener, or any other connecting feature.

The lower section 26 houses the higher-range speaker 22 and broadly comprises an outer wall 42, a baffle 44, and a plurality of vanes 46. The outer wall 42 includes an upper portion 48 and a lower portion 50 and forms an inner chamber 52. The lower section 26 and the outer wall 28 cooperatively form the lower port exit 40.

The upper portion 48 may be nested in the lower chamber 36 of the upper section 24 and thus may have a smaller outer diameter than an inner diameter of the outer wall 28. In some embodiments, the upper portion 48 may have a smaller outer diameter than an outer diameter of the lower portion 50. The upper portion 48 may extend upwards a selected vertical length so as to effect a desired length of the lower port channel 38. This optimizes low frequency output. To that end, if a cross section area of the lower port channel 38 and/or the lower port exit 40 is increased, the length of the lower port channel 38 should be increased. Likewise, if the cross section area of the lower port channel 38 and/or the lower port exit 40 is decreased, the length of the lower port channel 38 should be decreased. Meanwhile, decreasing the cross section area of the lower port exit 40 increases air velocity therethrough, which may cause port noise. Thus, the lower end of the outer wall 28 of the upper section 24 near the lower port exit 40 may be flared radially outward slightly (FIG. 5) so as to increase the cross section area of the lower port exit 40 and thereby reduce port noise. A longer flare provides more port noise mitigation.

The lower portion 50 may have an outer diameter substantially equal to the outer diameter of the outer wall 28 so that the lower portion 50 and the outer wall 28 appear essentially as vertical extensions of each other separated by the lower port exit 40. That is, the lower portion 50 may have a diameter of between approximately five inches and approximately twelve inches. In one embodiment, the lower portion 50 has an outer diameter of approximately ten inches (FIG. 3). In another embodiment, the lower portion 50 has an outer diameter of approximately six inches (FIG. 5). Alternatively, the lower portion 50 may have a diameter smaller or greater than the diameter of the outer wall 28.

The inner chamber 52 encloses the higher range speaker 26 therein and may be acoustically shaped for projecting higher-frequency soundwaves. To that end, the inner chamber 52 may be cylindrical, orthogonal, spherical, bell-shaped, or any other suitable shape.

The baffle 44 at least partially encloses the inner chamber 52 of the lower section 26 and may extend radially beyond the lower portion 50. That is, the baffle 44 may have a diameter greater than the diameter of the lower portion 50. The baffle 44 may be sound permeable or may have a number of openings for allowing higher frequency soundwaves from the higher-range speaker 22 to pass out of the inner chamber 52. The baffle 44 concentrates higher frequency soundwaves below the speaker assembly 12. The baffle 44 may be a cover, a plate, or any other suitable enclosing structure.

The vanes 46 extend radially outward from the upper portion 48 of the outer wall 42 of the lower section 26 to the outer wall 28 of the upper section so as to connect the lower section 26 to the upper section 24. While the vanes 46 are described herein as being part of the lower section 26 and configured to be connected to the upper section 24, the vanes 46 may alternatively be part of the upper section 24 and configured to be connected to the lower section 26. The vanes 46 also divide the lower port channel 38 into a plurality of radial spaces 54. The radial spaces 54 are vertically extending pathways through which low frequency soundwaves from the low-range speaker 20 may pass from the lower chamber 36 to the lower port exit 40. Each radial space 54 may be bounded by part of the upper portion 48, adjacent vanes, and part of the outer wall 28 of the upper section 24.

The hanging component 16 suspends the speaker assembly 12 from the ceiling 100 or other elevated structure. To that end, the hanging component 16 may be secured to an anchor or other mounting feature of the ceiling 100 near its upper end and secured to the connector 32 at its lower end. The hanging component 16 may support or house electrical or electronic wiring connected between the input circuit 18 and the sound system 102 and/or a power source. The hanging component 16 may be a cable, a chain, a wire, a rope, a rigid member, or any other suitable structure. Alternatively, the speaker housing 14 may be mounted directly to the ceiling 100 or other elevated structure.

The input circuit 18 receives audio signals from the sound system 102 and actively or passively sends the audio signals to the speakers 20, 22. The input circuit 18 may include an antenna, data bus, data port, or any other suitable communication component, an amplifier, a mixer, or any other suitable sound manipulation component. The input circuit 16 may be positioned in the upper section 24, the lower section 26, or any other location for improving signal reception.

The low range speaker 20 generates low frequency soundwaves and may be positioned in or mounted to the divider 30. The low range speaker 20 may be aimed upwards or downwards for projecting the low frequency soundwaves through the lower port channel 38 (via the radial spaces 54) and out the lower port exit 40. The low range speaker 20 may be a woofer, subwoofer, bass speaker, or other low-range speaker.

The higher-range speaker 22 generates higher frequency soundwaves and may be positioned in or mounted to the baffle 44. The higher-range speaker 22 is aimed downwards for projecting higher frequencies. The higher-range speaker 22 may be a full range speaker, a woofer with a tweeter, a woofer with a midrange and tweeter, or any other similar speaker or combination of speakers.

Use of the above-described speaker system 10 will now be described in more detail. First, the speaker assemblies 12 may be spaced apart from each other throughout the listening area such that low frequency soundwaves and higher frequency soundwaves can be received from at least one of the speaker assemblies 12 for most and/or key regions of the listening area. In this way, soundwaves of a particular crossover frequency from a low-range speaker located at a given position and soundwaves of the same crossover frequency from a higher-range speaker located at the same position will not form acoustically muted regions.

The speaker assemblies 12 may be suspended from the ceiling 100 or another elevated structure via the hanging elements 16 for providing audio to a room, an indoor or outdoor shopping space, a pavilion, or any other suitable area. The speaker assemblies 12 can be concealed or inconspicuously positioned so as to not draw attention to them. The cylindrical shape of the speaker housings 14 further diverts attention from the speaker assemblies 12.

The upper portion 48 may extend upwards a selected vertical length so as to effect a desired length of the lower port channel 38. This may allow acoustics of the low frequency soundwaves to have a desired effect and may reduce port noise.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A speaker assembly comprising:

a speaker housing including:

an upper section having an outer wall defining an upper chamber and a lower chamber; and a lower section at least partially received in the lower chamber of the upper section, the lower section having an outer wall including an upper portion and a lower portion cooperatively defining an inner chamber, the upper portion extending upward into the lower chamber of the upper section and being spaced radially inward from the outer wall of the upper section so as to form a lower port channel, the lower portion being spaced below the outer wall of the upper section so as to form a lower port exit;

an input circuit for receiving audio signals from an audio source;

a low-range speaker positioned in the upper chamber of the upper section and coupled with the input circuit for generating low frequency soundwaves and projecting the low frequency soundwaves through the lower port channel and outward from the lower port exit; and a higher-range speaker positioned in the inner chamber of the lower section and coupled with the input circuit for generating higher frequency soundwaves, the speaker assembly being configured to be suspended from an elevated structure and configured to be spaced from other speaker assemblies such that each speaker assembly produces low frequency soundwaves and higher frequency soundwaves so as to reduce out-of-phase crossover frequency wave cancellation effects within a listening area of the speaker assembly.

2. The speaker assembly of claim 1, further comprising a plurality of vanes connecting the lower section to the upper section, the vanes partitioning the lower port channel into a plurality of radial spaces.

3. The speaker assembly of claim 1, the speaker housing being cylindrical.

4. The speaker assembly of claim 3, the lower portion of the lower section having an outer diameter equal to an outer diameter of the outer wall of the upper section.

5. The speaker assembly of claim 1, the lower section further comprising a baffle enclosing the inner chamber, the higher-ranger speaker being mounted to the baffle.

6. The speaker assembly of claim 5, the baffle having a width greater than widths of the upper section and the lower section.

7. The speaker assembly of claim 1, the upper section further comprising a connector for attaching the hanging component to the speaker housing.

8. The speaker assembly of claim 1, the outer wall of the upper section having a lower end being flared radially outward near the lower port exit.

9. The speaker assembly of claim 1, the speaker housing having a diameter of approximately ten inches and a height of approximately twenty-seven inches.

10. The speaker assembly of claim 1, the speaker housing having a diameter of approximately six inches and a height of approximately thirty-seven inches.

11. A speaker system comprising:

a plurality of speaker assemblies each comprising:

a speaker housing including:

an upper section having an outer wall defining an upper chamber and a lower chamber; and a lower section at least partially received in the lower chamber of the upper section, the lower section having an outer wall including an upper portion and a lower portion cooperatively defining an inner chamber, the upper portion extending upward into the lower chamber of the upper section and being spaced radially inward from the outer wall of the upper section so as to form a lower port channel, the lower portion being spaced below the outer wall of the upper section so as to form a lower port exit;

an input circuit for receiving audio signals from an audio source;

a low-range speaker positioned in the upper chamber of the upper section and coupled with the input circuit for generating low frequency soundwaves and projecting the low frequency soundwaves through the lower port channel and outward from the lower port exit; and a higher-range speaker positioned in the inner chamber of the lower section and coupled with the input circuit for generating higher frequency soundwaves, the speaker assemblies being configured to be suspended from an elevated structure and configured to be spaced from each other such that each speaker assembly produces low frequency soundwaves and higher frequency soundwaves so as to reduce out-of-phase crossover frequency wave cancellation effects within a listening area of the speaker system.

12. The speaker system of claim 1, each speaker assembly further comprising a plurality of vanes connecting the lower section to the upper section, the vanes partitioning the lower port channel into a plurality of radial spaces.

13. The speaker system of claim 1, the speaker housing being cylindrical.

14. The speaker system of claim 3, the lower portion of the lower section having an outer diameter equal to an outer diameter of the outer wall of the upper section.

15. The speaker system of claim 1, the lower section further comprising a baffle enclosing the inner chamber, the higher-ranger speaker being mounted to the baffle.

16. The speaker system of claim 5, the baffle having a width greater than widths of the upper section and the lower section.

17. The speaker system of claim 1, the upper section further comprising a connector for attaching the hanging component to the speaker housing.

18. The speaker system of claim 1, the outer wall of the upper section including a lower end being flared radially outward near the lower port exit.

19. The speaker system of claim 1, the speaker housing having a diameter of approximately ten inches and a height of approximately twenty-seven inches.

20. A speaker system comprising:

a plurality of speaker assemblies each comprising:

a cylindrical speaker housing including:

an upper section having an outer wall and a connector, the outer wall including a divider and defining an upper chamber and a lower chamber, the divider partitioning the lower chamber from the upper chamber; and a lower section at least partially received in the lower chamber of the upper section, the lower section having an outer wall and a baffle, the outer wall including an upper portion and a lower portion cooperatively defining an inner chamber, the upper portion extending upward into the lower chamber of the upper section and being spaced radially inward from the outer wall of the upper section so as to form a lower port channel, the lower portion being spaced below the outer wall of the upper section so as to form a lower port exit, the baffle extending across a lower end of the lower portion, the upper section and the lower section having an outer diameter of approximately ten inches, the cylindrical speaker housing having a height of approximately twenty-seven inches;

an input circuit for receiving audio signals from an audio source;

a low-range speaker mounted to the divider and positioned in the upper chamber of the upper section and coupled with the input circuit for generating low frequency soundwaves and projecting the low frequency soundwaves through the lower port channel and outward from the lower port exit; and a higher-range speaker mounted on the baffle and positioned in the inner chamber of the lower section and coupled with the input circuit for generating higher frequency soundwaves, the speaker assemblies being configured to be suspended from an elevated structure and configured to be spaced from each other such that each speaker assembly produces low frequency soundwaves and higher frequency soundwaves so as to reduce out-of-phase crossover frequency wave cancellation effects within a listening area of the speaker system.

* * * * *